US006591911B1

(12) United States Patent
Markel et al.

(10) Patent No.: US 6,591,911 B1
(45) Date of Patent: Jul. 15, 2003

(54) MULTI-DIRECTIONAL GUN CARRIER METHOD AND APPARATUS

(75) Inventors: Daniel C. Markel, Pearland, TX (US); Victor M. Vu, Sugar Land, TX (US); Simon L. Farrant, Houston, TX (US); James E. Brooks, Manvel, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/620,100

(22) Filed: Jul. 20, 2000

Related U.S. Application Data

(60) Provisional application No. 60/145,181, filed on Jul. 22, 1999.

(51) Int. Cl.[7] ..... E21B 29/00; E21B 29/02

(52) U.S. Cl. ..... 166/297; 166/55.2; 175/4.57; 89/1.15; 102/312

(58) Field of Search ..... 166/55, 55.2, 63, 166/297; 175/2, 4.57, 4.6; 89/1.15; 102/310, 311, 312, 313, 314

(56) References Cited

U.S. PATENT DOCUMENTS

| | | | | |
|---|---|---|---|---|
| 2,799,224 A | | 7/1957 | Long | |
| 2,927,534 A | | 3/1960 | Le Bus | |
| 3,094,930 A | | 6/1963 | Blair | |
| 3,100,443 A | | 8/1963 | Pohoriles | |
| 4,326,462 A | | 4/1982 | Garcia et al. | |
| 4,393,946 A | | 7/1983 | Pottier et al. | |
| 4,598,775 A | | 7/1986 | Vann et al. | |
| 4,658,900 A | | 4/1987 | Stout | |
| 4,681,037 A | | 7/1987 | Regalbuto | |
| 4,694,754 A | | 9/1987 | Dines et al. | |
| 4,716,833 A | * | 1/1988 | Regalbuto | 102/320 |
| 4,753,301 A | * | 6/1988 | Berry | 175/4.6 |
| 4,829,901 A | | 5/1989 | Yates, Jr. | |
| 4,832,134 A | | 5/1989 | Gill | |
| 4,881,445 A | | 11/1989 | Hayes | |
| 4,951,744 A | | 8/1990 | Rytlewski | |
| 5,095,999 A | | 3/1992 | Markel | |
| 5,107,929 A | | 4/1992 | Lopez de Cardenas | |
| 5,211,714 A | * | 5/1993 | Jordan et al. | 166/297 |
| 5,421,418 A | | 6/1995 | Nelson et al. | |
| 5,542,480 A | | 8/1996 | Owen et al. | |
| 5,544,711 A | * | 8/1996 | Aitken et al. | 175/4.6 |
| 5,590,723 A | | 1/1997 | Walker et al. | |
| 5,619,008 A | * | 4/1997 | Chawla et al. | 102/310 |
| 5,662,178 A | * | 9/1997 | Shirley et al. | 175/4.53 |
| 5,701,964 A | | 12/1997 | Walker et al. | |
| 5,816,343 A | | 10/1998 | Markel et al. | |

OTHER PUBLICATIONS

Lackey, Brandon; *New Deep–Star Perforating System Provides Deeper Penetration to Maximize Production*; Houston, Texas; Aug. 28, 1995; pp. 1.

Halliburton; *Increase Your Production with Deeper Charge Penetration*; Deep–Star™ Perforating System, 1996, pp. 1–4.

* cited by examiner

*Primary Examiner*—David Bagnell
*Assistant Examiner*—Jennifer H Gay
(74) *Attorney, Agent, or Firm*—Trop, Pruner & Hu P.C.; Jeffrey Griffin; Brigitte Jeffery

(57) ABSTRACT

A perforating device has a carrier strip (e.g., a linear strip) on which are mounted capsule charges arranged in a desired pattern. The pattern can be a phased pattern, such as a spiral pattern, a triphase pattern, and so forth. Alternatively, the pattern is a 0°- or 180°-phased pattern for performing oriented perforating, with the capsule charges shooting in opposite directions with respect to a desired plane in the formation of the wellbore. One or more brackets can be used to mount the capsule charges to the strip. In one arrangement, the bracket has plural support rings to connect to the capsule charges. In another arrangement, multiple brackets each holding one or more capsule charges may be employed. In yet another arrangement, a tube containing the capsule charges in a phased arrangement can be used. In a further arrangement, instead of using brackets, threaded openings are provided in the carrier strip in which capsule charges can be threadably connected to provide the desired phased pattern.

17 Claims, 16 Drawing Sheets

MULTI-DIRECTIONAL GUN CARRIER METHOD AND APPARATUS

This application claims priority under 35 U.S.C. §119(e) to U.S. Provisional Application Ser. No. 60/145,181, entitled "Multi-Directional Gun Carriers," filed Jul. 22, 1999.

TECHNICAL FIELD

The invention relates to multi-directional gun carriers for use in perforating guns for downhole applications.

BACKGROUND

To complete a well, one or more formation zones adjacent the wellbore are perforated to allow fluid from the formation zones to flow into the well for production to the surface or to allow injection fluids to be applied into the formation zones. A perforating gun string may be lowered into the well and the guns fired to create openings in casing and to extend perforations into the surrounding formation. Charges carried in a perforating gun are often phased to shoot in multiple directions around the circumference of the wellbore. Loading the gun with the charges pointed in multiple directions as opposed to a single direction is favorable since it is likely to improve fluid flow/drainage of the formation. Typically, charges used in a perforating gun include capsule charges or non-capsule charges. Capsule charges are each individually sealed by a capsule against corrosive fluids and pressures in the wellbore. Non-capsule charges are typically contained in a hollow carrier.

Typically, perforating guns (which include gun carriers and shaped charges mounted on or in the gun carriers) are lowered through tubing or other pipes to the desired well interval. Gun carriers can be retrievable or expendable. Retrievable carriers are designed to remain substantially intact so that they can be retrieved to the surface. An example of a retrievable gun carrier is a strip on which capsule charges are mounted and which is retrieved after perforating. In contrast, expendable carriers are designed to shatter after detonation and fall to the bottom of the well.

By remaining intact after detonation, retrievable gun carriers provide the advantages of reducing the amount of debris that is left in the wellbore and providing shot verification when the carrier is retrieved to the surface. However, with some types of retrievable carriers, detonation of the capsule charges may cause deformation of the carrier to increase the cross-sectional profile of portions of the carrier. This may cause a problem when the carrier is retrieved through a tubing, a pipe, or other structure having reduced diameter with respect to the casing since the carrier may have been warped so that its profile at certain portions is larger than the diameter of the tubing, pipe, or other structure. Deformation of such gun carriers may be even more pronounced when a perforating gun is shot in a gas environment.

Thus, a need exists to provide a gun with a retrievable carrier carrying charges in a phased arrangement, with the carrier having improved deformation characteristics upon detonation of the charges.

Different types of retrievable and expendable carriers (having different shapes and configurations) are available to carry capsule charges. One common type is the linear strip. A limitation of a conventional linear strip is that the available phasings of capsule charges may be limited. To achieve a larger number of phasing patterns, such as 45° or 60° spiral phasing patterns, spiral strips have been used. A spiral strip extends a full circumference in a spiral fashion. However, making a spiral strip is generally more complex since special equipment is needed to form the spiral. Further, with spiral strips, the detonation force applied against a strip may tend to open up the strip, making it more difficult to retrieve for a retrievable gun. Further, with spiral strip guns, some portions of the detonating cord are in contact with the inner wall of a pipe or tubing when the guns are being lowered, which may damage the detonating cords, especially those having lead or other metal jackets. A need thus continues to exist for carrier strips, whether retrievable or expendable, of improved design that are flexible enough to provide various different phasings and that addresses various shortcomings of conventional strip guns.

SUMMARY

In general, according to one embodiment, a perforating gun comprises a plurality of capsule charges, a carrier strip, and a bracket to hold a plurality of capsule charges in a phased arrangement having a plurality of perforating directions, with the bracket coupled to the carrier strip.

In general, according to another embodiment, a carrier strip for use in a perforating device comprises an elongated, linear member having a plurality of threaded openings arranged along the elongated, linear member. The threaded openings are adapted to connect to at least some of plural capsule charges arranged in a phasing pattern having a plurality of perforating directions.

In general, according to another embodiment, an oriented perforating device for use in a deviated or horizontal wellbore comprises a strip, and capsule charges arranged at two or less predetermined orientations with respect to the strip. The strip provides an eccentric weight to rotate the perforating device so that the strip is at a low side of the deviated horizontal wellbore and the capsule charges are pointed in the two or less predetermined orientations with respect to the low side of the wellbore.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Figure 1:
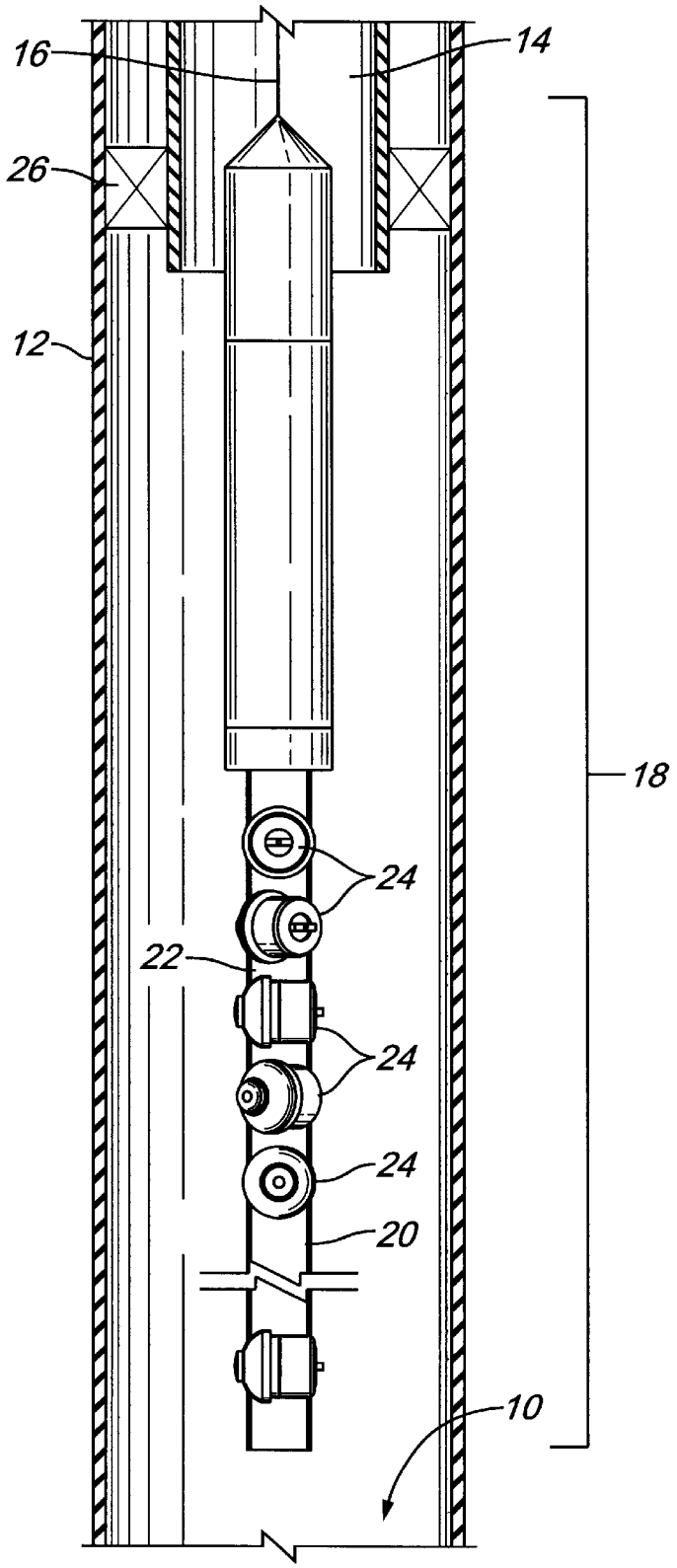
FIG. 1 illustrates an embodiment of a through-tubing perforating gun string positioned in a wellbore.

Referring to FIG. 1, a through-tubing perforating gun string 18 is positioned in a wellbore 10 that is lined with casing 12. A tubing or pipe 14 extends inside the casing 12, and a portion of the wellbore 10 is isolated by packers 26 set between the exterior of the tubing 14 and the interior of the casing 12. The perforating gun string 18 may be lowered through the tubing or pipe 14 on a carrier line 16 and positioned at a desired wellbore interval where the gun string 18 is fired to create perforations in the surrounding casing and formation.

The perforating gun string 18 according to one embodiment includes a perforating gun 22 having a carrier strip 20 (such as a linear strip) to which capsule charges 24 are attached in a phased arrangement. As used here, a "linear strip" refers to an elongated member that extends generally along an axis. The carrier strip 20 may be a retrievable or an expendable carrier. The capsule charges may be attached to the strip in a number of ways, such as by use of brackets, threaded connections, clips, fasteners, or any other attachment mechanism. The carrier strip 20 holds the capsule charges in a desired phased arrangement using one of several attachment mechanisms.

Figure 20:
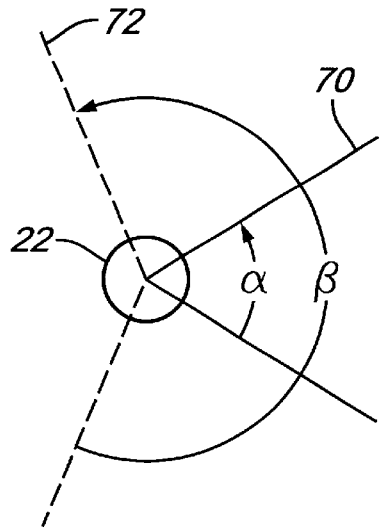
FIG. 20 illustrates perforation sectors defining ranges of directions of perforation for perforating guns in accordance with some embodiments.

Several different phasings are possible with different embodiments of the carrier strip 20. Example phasings include 0° phasing, 180° phasing, 0°/+45°/−45° twisted or triphase phasing, 40° spiral phasing, 45° spiral phasing, 60° spiral phasing, and so forth. Other phasing patterns include those in which the capsule charges are pointed in directions within a perforation sector having a predetermined angle, such as 90°, 120°, 180°, 270°, 360°, and so forth. As illustrated in FIG. 20, the perforating gun 22, when viewed from the top, can be arranged to shoot within a sector 70 having an angle $\alpha$, another 72 having an increased angle $\beta$, or other sectors. Within each sector, the capsule charges may be aimed in one or more directions. Further phasing patterns may also be possible depending on the needs of the well operator.

As used here, capsule charges (or other types of charges) are referred to as being phased if they point in more than one direction (the charges are multi-directional). In the example phasing patterns listed above, the 180° phasing pattern includes two perforating directions: 0° and 180°. The 0°/+45°/−45° twisted phasing, 40°spiral phasing, 45° spiral phasing, 60° spiral phasing, and other spiral phasing patterns provide three or more perforating directions, with the 40°, 45° and 60° spiral phasing patterns providing greater than four directions.

In accordance with some embodiments, the carrier strip 20 includes a linear strip that generally includes an elongated member formed of metal or other suitable material to carry capsule charges. Even though a linear carrier strip is employed according to some embodiments, a number of different phasings may be accomplished by use of support brackets or other attachment mechanism to attach the capsule charges in the desired phased arrangements, as described further below.

Instead of being linear, the strip 20 may also have bends or curves along the length of the strip. Such bends or curves may provide a generally snake-like or zigzag shape, for example. However, unlike a spiral strip, strips in accordance with embodiments of the invention extend less than a full circumference when viewed from the top while allowing flexible phased arrangements, including spiral phased arrangements, twisted phased arrangements, and phased arrangements having perforating directions defined within a perforation sector having a relatively large coverage angle. For example, the coverage angle may be greater than 180°, which include a spiral-phased arrangement having a 360° coverage angle.

Figure 2:
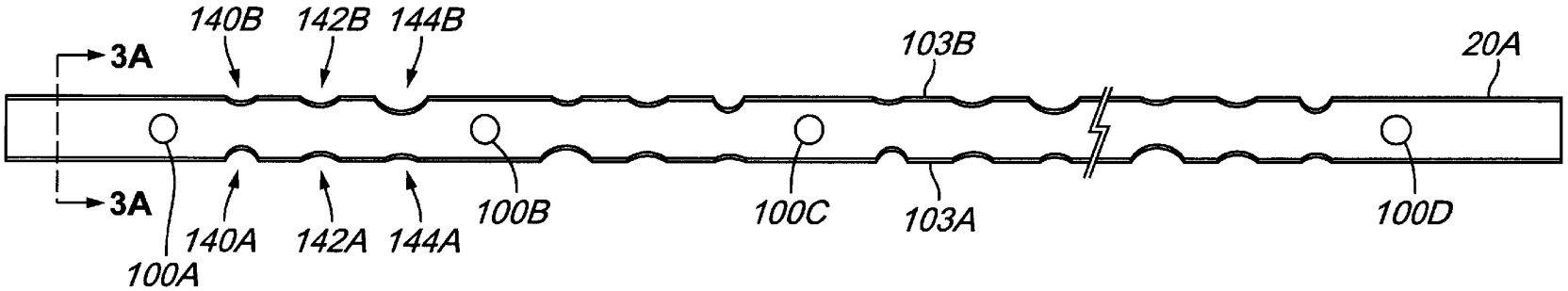
FIGS. 2, 4, and 5 illustrate several embodiments of a linear carrier strip for use in the perforating gun string of FIG. 1.
Figure 3B:
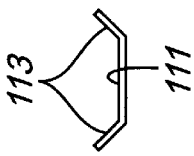
FIGS. 3A–3C are cross-sectional views of sections of linear carrier strips according to several embodiments.
Figure 3C:
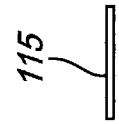
Figure 3A:
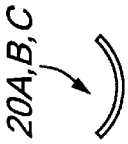

Referring to FIG. 2, a linear carrier strip 20A includes a plurality of holes spaced at predetermined points to receive 0° and 180°-phased capsule charges. The strip 20A is generally linear but has a cross-section of an arc, as shown in FIG. 3A. In further embodiments, strips having other cross-sectional shapes may be used, such as that shown in FIG. 3B, which includes a flat surface 111 with two angled edge portions 113. A flat strip 115 (FIG. 3C) may also be employed in other embodiments. Other possible shapes may include convex strips, V-shaped strips, and other shapes.

The cross-section of the carrier can be any type of geometry provided that it allows room for capsule charges to be attached and has an outer profile that conforms to the surface of a pipe, such as a production tubing or other cylindrical structure through which the carrier is run or retrieved.

A 0°-phased capsule charge refers to a capsule charge in which the general direction of its perforating jet upon detonation points toward the strip. A 180°-phased capsule charge refers to a charge in which its perforating jet points in the opposite direction away from the strip. Thus, in one example configuration that employs a 45° spiral phasing pattern, the capsule charges are arranged in the following sequence: 0°, 45°, 90°, 135°, 180°, 225°, 270°, 315°, 0° and so forth. The noses of the 0°-phased capsule charges 24 (FIG. 1) are mounted in threaded openings 100A and 100C of the linear carrier strip 20A.

Figure 11:
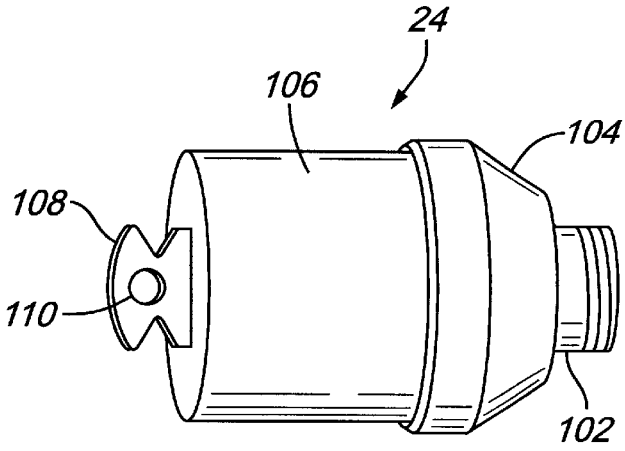
FIGS. 11 and 12A–12B illustrate two types of capsule charges in accordance with some embodiments for use in the perforating gun string of FIG. 1.

As illustrated in FIG. 11, each capsule charge 24 includes a threaded nose portion 102 that is engageable in a corresponding threaded opening 100A–D of the carrier strip 20A (FIG. 2). In another embodiment, the nose of the capsule charge may be mounted in the opening by another mechanism such as a clip, fastener, and so forth. The nose portion 102 extends from a cap 104 that is fitted over a capsule body 106. A detonating cord retainer 108 is attached to the tail end of the capsule body 106, and the retainer 108 includes an opening 110 through which a detonating cord can be fitted.

Figure 12A:
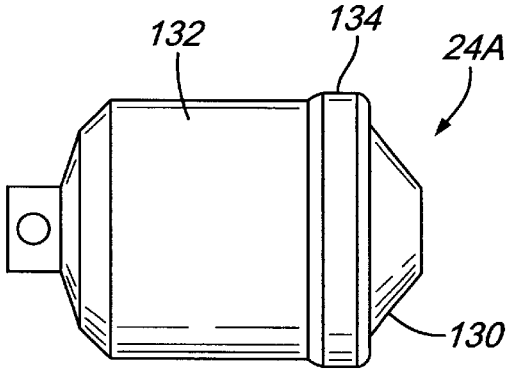
Figure 12B:
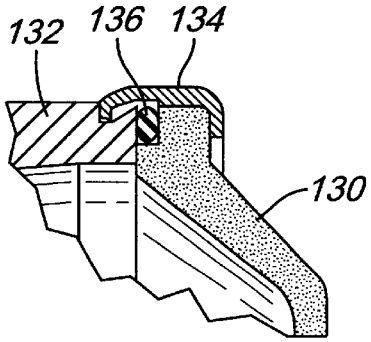

Referring to FIGS. 12A–12B, in another embodiment, a capsule charge 24A has a ceramic cap 130 that is attached to the capsule charge body 132 by a crimp ring 134. One such capsule charge is described in pending U.S. patent application Ser. No. 09/569,805, entitled "Encapsulated Shaped Charge for Well Perforation," filed May 12, 2000, to John Aitken, et al., which claims priority under 35 U.S.C. §119(e) to U.S. Provisional Patent Application Serial No. 60/143,468, entitled "Encapsulated Shaped Charge for Well Perforation," filed Jul. 13, 1999, both hereby incorporated by reference. An enlarged view of the attachment of the ceramic cap 130 to the capsule charge body 132 is illustrated in FIG. 12B. Inside the crimp ring 134, an elastomer seal ring 136 is mounted to provide a seal. Use of the ceramic-cap capsule charge 24A provides a sand grain debris after detonation of the capsule charge 24A. This reduces the size of the debris as compared to capsule charges using metal caps. In further embodiments, other types of capsule charges may be employed.

Figure 7:
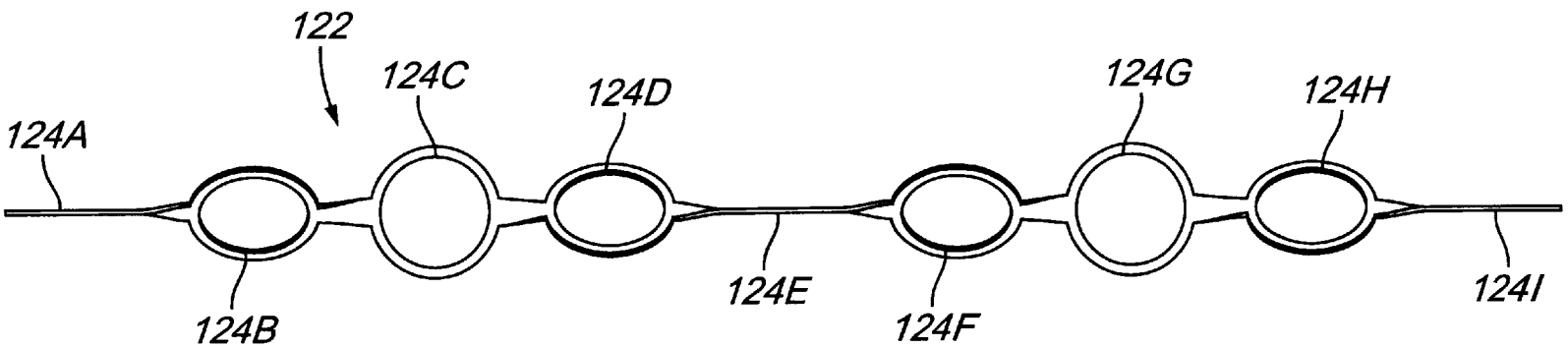

Referring again to FIG. 2, in the 45° spiral phasing pattern, the 0°-phased capsule charges 24 are threadably engaged (or mounted by some other mechanism) in the openings 100A and 100C while all the other capsule charges are not directly mounted to the carrier strip 20A. Instead, such other capsule charges are mounted in a retainer bracket, such as the bracket 122 shown in FIG. 7, which includes a sequence of integrally attached support rings (124A–124I illustrated) formed of a deformable material. The retainer bracket 122 may be similar in design to the strip disclosed in U.S. Pat. No. 5,816,343, entitled "Phased Perforating Guns," granted on Oct. 6, 1998, and which is hereby incorporated by reference. The retainer bracket 122 may be the same design as that described in U.S. Pat. No. 5,816,343, or it may be made thinner to reduce debris after detonation. On the other hand, if retrievability is desired, then the bracket 122 can be made thicker.

The retainer bracket 122 is twisted such that the desired phasing pattern is provided for the capsule charges once they are mounted in the support rings 124A–124I and the 0°-phased capsule charges, mounted in support rings 124A and 124I, respectively, are engaged in openings 100A and 100C, respectively. The other capsule charges mounted in support rings 124B–124H (the 45°, 90°, 135°, 180°, 225°, 270°, and 315°-phased capsule charges, respectively) are not directly mounted to the linear strip 20A, but instead, are maintained in position by the retainer bracket 122. In the example 45° spiral phasing pattern, a direct mounting of a capsule charge to the linear strip 20A is made every other eight capsule charges. In effect, the 0°-phased capsule charges fix the position of the retainer bracket 122 with respect to the linear strip 20A. In turn, the other capsule charges mounted in the support rings 124 between the 0°-phased capsule charges are held in their desired positions by the retainer bracket 122.

A bracket having multiple support members for multiple capsule charges have advantages over individual support brackets for individual capsule charges. Attachment is made easier since fewer attachment mechanisms are needed. The bracket having multiple support members can be designed to break up more easily than the individual brackets.

In a further embodiment, a similar type of arrangement may be provided for other phasings, such as the 180° phasing, 40° spiral phasing, 60° spiral phasing, and 0°/+45°/−45° twisted or triphase phasing patterns or other patterns in which multiple perforating directions are defined in a perforation sector having a predetermined angle (up to 360°).

Figure 6:
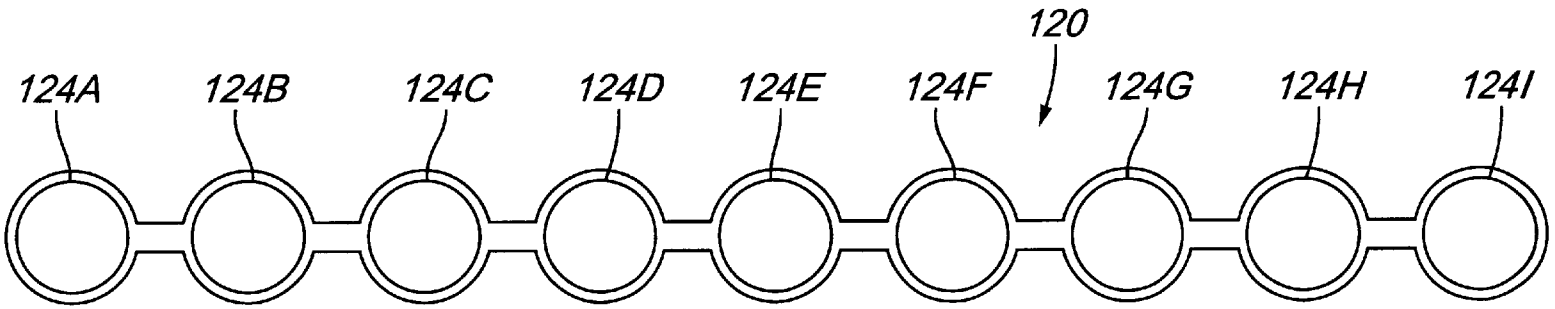
FIGS. 6 and 7 illustrate a retainer bracket for holding capsule charges in position with respect to the carrier strips of FIGS. 2, 4, and 5.

The retainer bracket 122 initially may be formed from a relatively flat piece of structure 120, as illustrated in FIG. 6. The sequence of support rings 124 in the structure 120 may be formed by cutting (e.g., laser cutting, punch cutting) a flat piece of metal. After the rings have been cut from the sheet of metal, the structure 120 may be twisted to form the retainer bracket 122 of FIG. 7. The pattern of twists in the structure 120 is dependent on the desired phasing pattern of the capsule charges mounted into the support rings 124. The retainer bracket 122 is designed to break apart upon detonation of the capsule charges. The thickness of the retainer bracket 122 may be reduced to decrease the amount of debris left in the well after detonation of the capsule charges.

For the capsule charges that are not directly mounted in the linear strip 20A, a different type of capsule charge may be used to reduce the debris in the wellbore after the perforating gun is fired. The direction of the perforating jet when a capsule charge, such as the capsule charge 24 of FIG. 11, is detonated is typically through the nose 102 of the capsule charge. The perforating jet shoots through the cap 104 but the cap 104 remains attached to the strip 20A (FIG. 2) even after the capsule charge 24 has detonated. As a result, the cap 104 of a capsule charge that is attached to the strip 20A can be retrieved with the strip 20A after the perforating gun string 18 is fired.

Upon detonation of the capsule charges, the retainer bracket 122 is blown apart so that it is not part of the retrievable components of the gun string 18. As a result, whatever remains of the capsule charges after detonation will be lost in the wellbore. To reduce the amount of debris in the wellbore, the capsule charge 24A (FIG. 2A) with a ceramic cap (instead of a metal cap as used in the capsule charge 24 of FIG. 11) may be employed.

Figure 8A:
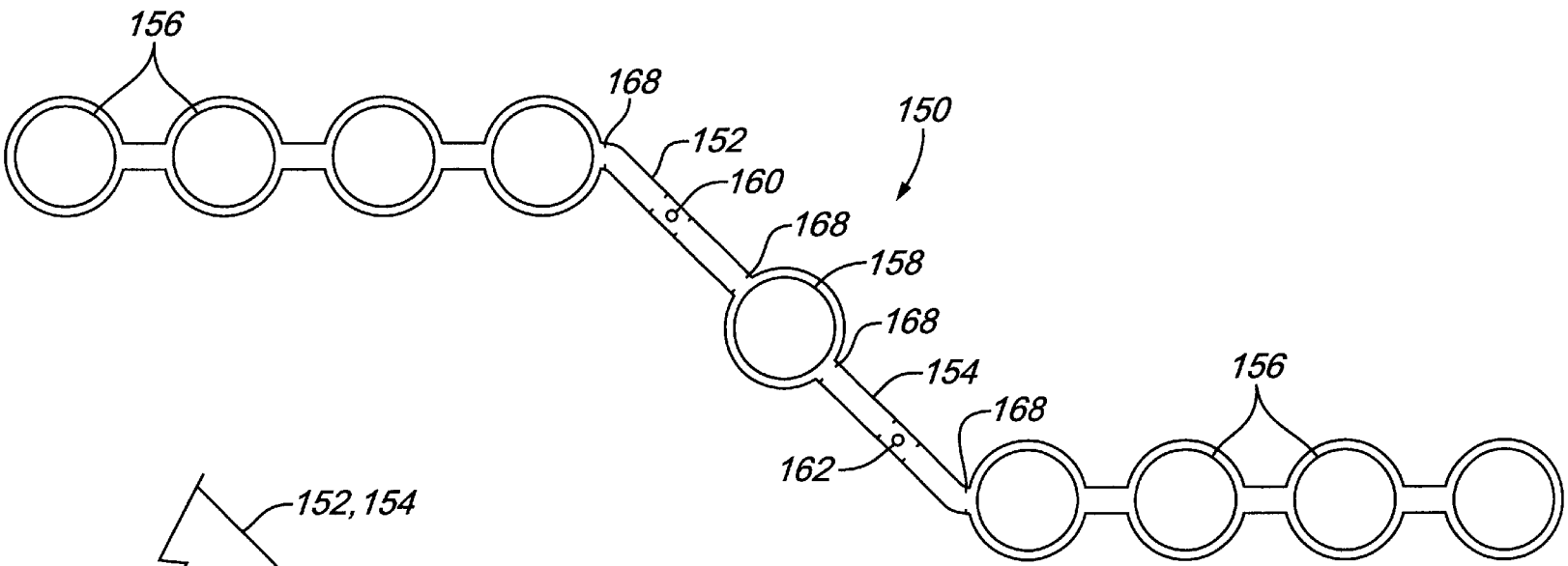
FIGS. 8A–8B illustrate another embodiment of a retainer bracket for holding capsule charges in position with respect to the carrier strips of FIGS. 2, 4, and 5.
Figure 8B:
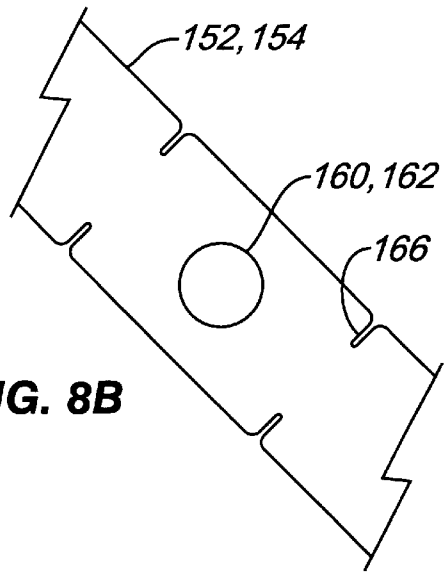

Referring to FIGS. 8A–8B, a retainer bracket 150 according to another embodiment is illustrated. In its initial, untwisted configuration, the bracket 150 has attachment members 152 and 154 on either side of a support ring 158. The attachment members 152 and 154 can be bent so that the bracket 150 can be attached directly to a linear strip. The attachment mechanisms can include screws, rivets, and so forth. Even with the added attachment mechanisms, the number may still be less than for individual brackets, since each attachment mechanism may be employed for two or more capsule charges.

A magnified portion of the attachment member 152 or 154 is illustrated in FIG. 8B. As shown, cuts 166 are formed at four locations on the attachment member 152 or 154 proximal the opening 160 or 162. The cuts 166 enable easy bending of the attachment member 152 or 154 at a line corresponding to each pair of cuts 166. Similar cuts 168 are provided on the attachment members 152 and 154 close to the support rings 156, 158 to facilitate bending at those locations. Once the attachment members 152 and 154 are bent at the locations corresponding to cuts 166 and 168, the bracket 150 effectively looks like the bracket 120 of FIG. 6 except with the attachment members 152 and 154 depending from the bracket 150. The bracket 150 can then be twisted in the desired manner to provide for a phased arrangement of capsule charges mounted into the support rings 156 and 158. With the bracket 150, attachment to the carrier strip is provided by the 0°-phased capsule charges and the attachment members. This enhances the rigidity of the gun.

Figure 9A:
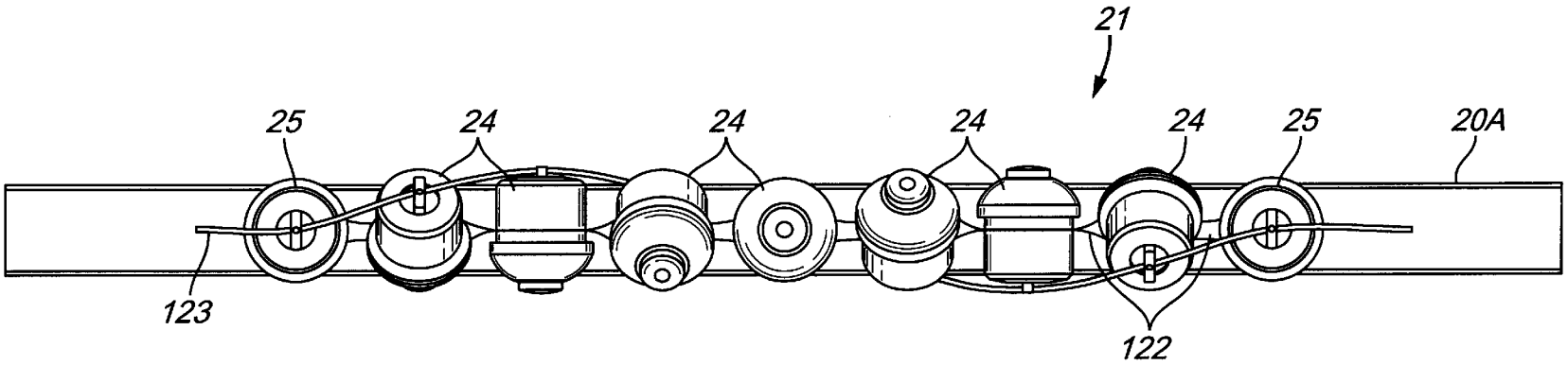
FIGS. 9A–9B are assembly views of a perforating gun in accordance with one embodiment including the carrier strip of FIG. 2 and the retainer bracket of FIG. 7.
Figure 9B:
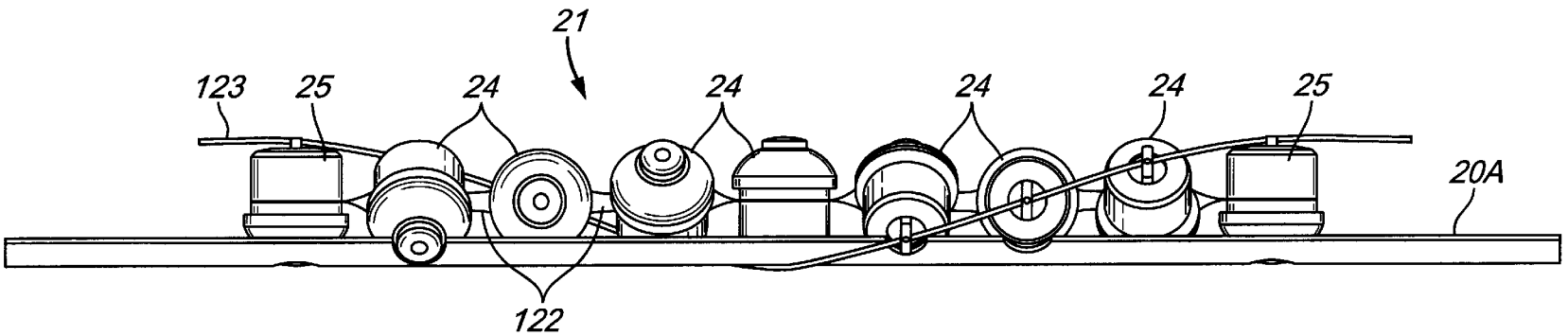

Referring to FIGS. 9A–9B, a perforating gun 21 including capsule charges, the retainer bracket 122, a detonating cord 123, and the linear strip 20A is illustrated. Capsule charges indicated as 25 are the 0°-phased capsule charges that are directly attached to or mounted on the strip 20A. The remaining capsules 24 are maintained in a phasing pattern by the retainer bracket 122. Each of the capsule charges 24 and 25 are mounted generally at their mid-sections into a corresponding support ring 124 (FIG. 7) of the retainer bracket 122. With the spiral pattern of capsule charges provided by the gun 21, the detonating cord 123 runs in a generally helical fashion along the backs of the capsule charges.

In another embodiment, the bracket 122 can be replaced with the bracket 150.

Figure 9C:
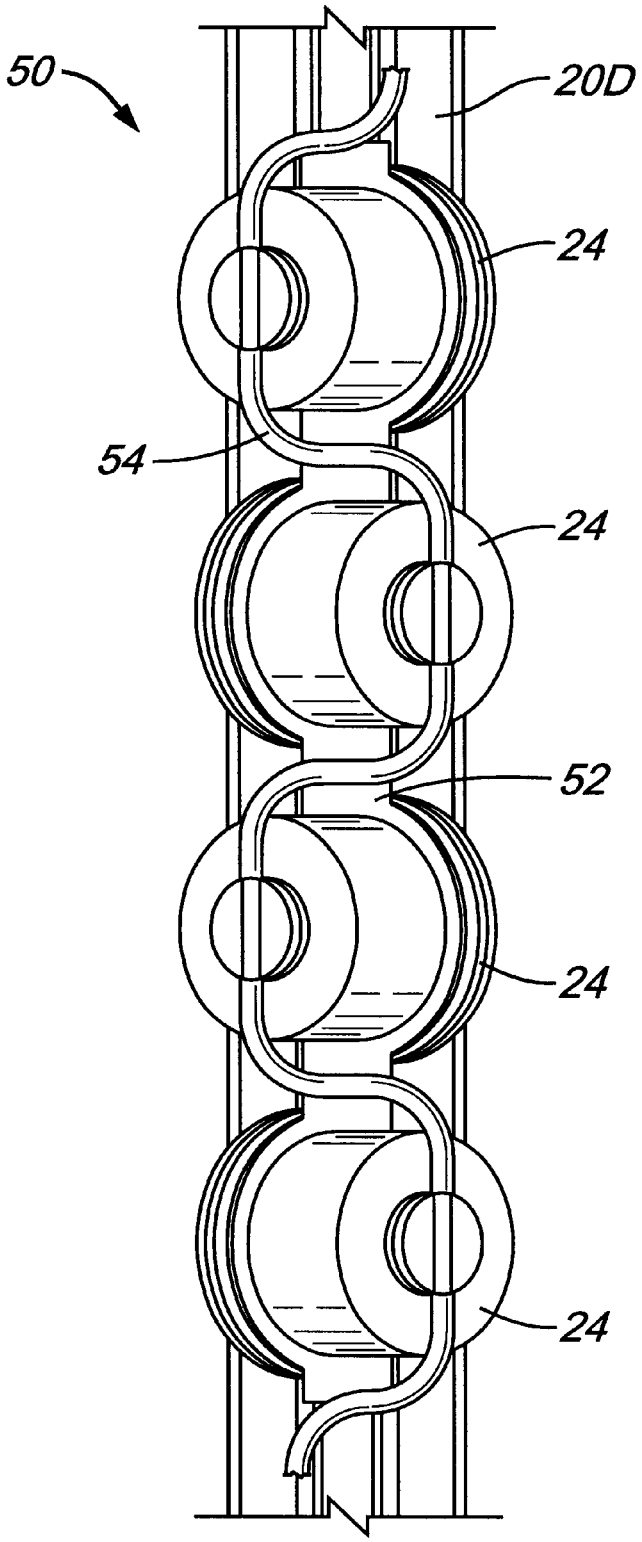
FIG. 9C illustrates a perforating gun in accordance with another embodiment.

Referring to FIG. 9C, a perforating gun 50 in accordance with another embodiment includes a linear strip 20D and a plurality of capsule charges 24 arranged in a ±45° phasing pattern to define a perforation sector of 90°. The capsule charges 24 are mounted in a retainer bracket 52 having a plurality of support rings of similar design to the bracket 122 of FIG. 7. A detonating cord 54 attached to the backs of the capsule charges 24 run in a back and forth path and is non-helical. The brackets described above have multiple support rings or elements for holding more than two capsule charges.

Figure 9D:
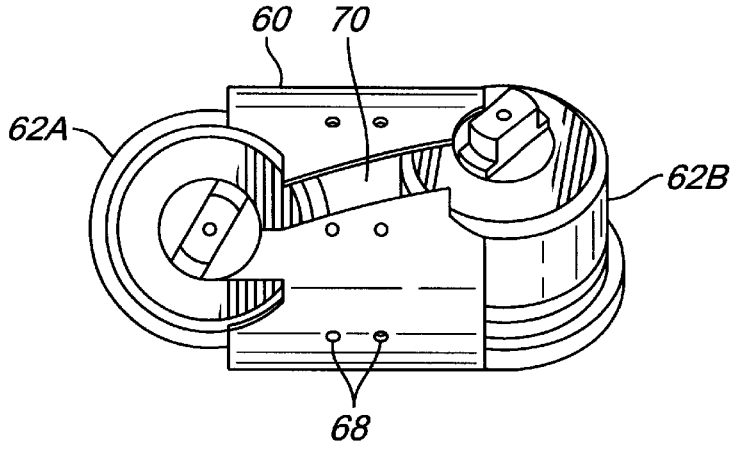
FIGS. 9D–9F illustrate a bracket for holding a pair of capsule charges in accordance with a further embodiment.
Figure 9E:
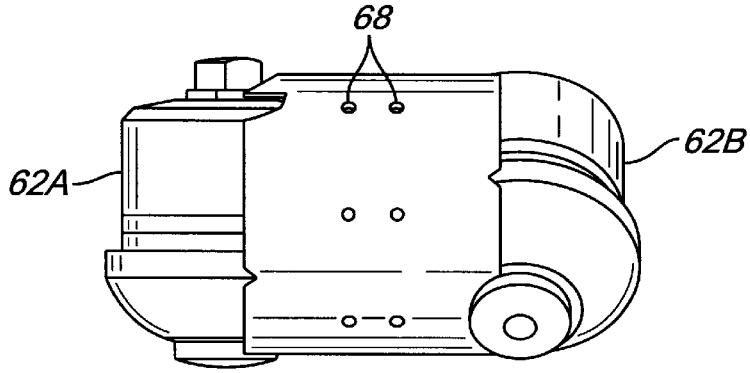
Figure 9F:
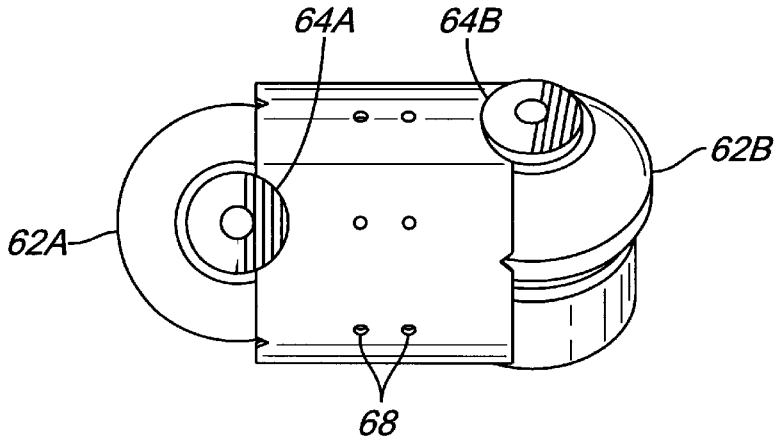

Referring to FIGS. 9D–9F, in accordance with another embodiment, a retainer 60 is designed to hold two adjacent capsule charges 62A and 62B that are angularly offset with respect to each other. The retainer 60 is generally tubular in shape and has receiving elements to attach to the shaped charges 62. As shown in FIG. 9F, cuts 64A and 64B are formed in the retainer 60 to receive the noses of respective capsule charges 62A and 62B. The retainer 60 is formed from a generally flat piece of metal and bent to achieve the generally tubular shape. A gap 70 is provided between the ends of the retainer 60 to facilitate insertion of the capsule charges 62A and 62B into the retainer 60.

One or more fasteners (e.g., screws, rivets, etc.) can be inserted through openings 68 provided along the circumference of the retainer 60 to mount the retainer 60 to a strip (not shown). Plural retainers 60 each attached to a pair of capsule charges can be mounted onto the strip. A number of different phasing patterns may be achieved with the plurality of retainers 60.

Figure 10A:
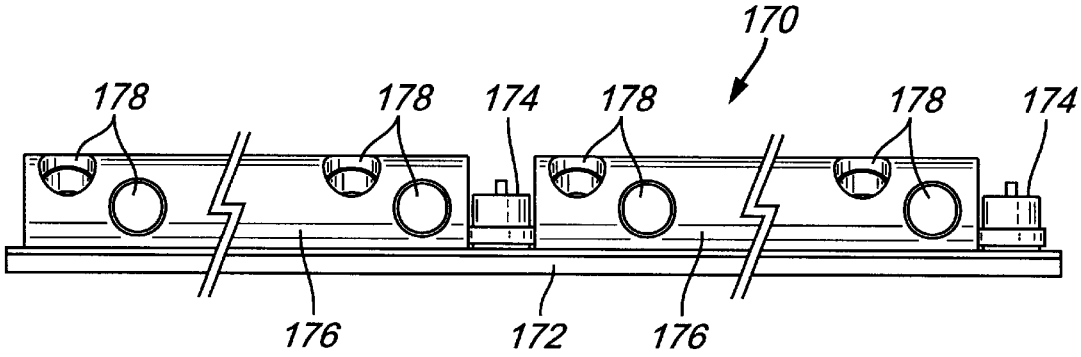
FIG. 10A illustrates a perforating gun having capsule charges and tubes for mounting some of the capsule charges in a phased arrangement.
Figure 10B:
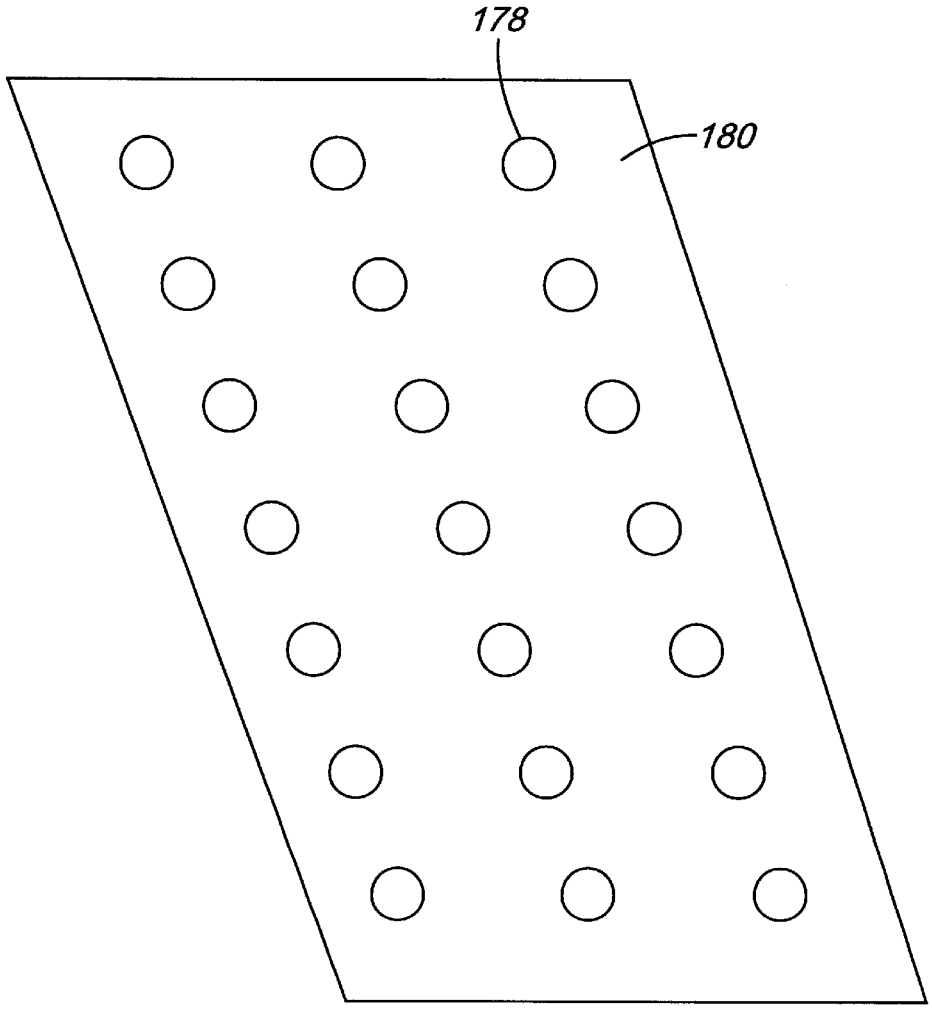
FIG. 10B illustrates a flat metal sheet having an array of openings therein from which a tube of FIG. 10A can be formed.

Referring to FIGS. 10A–10B, in accordance with yet another embodiment, another different type of retaining bracket is used in a strip gun 170. In this embodiment, the retaining bracket includes one or more tubes 176. The gun 170 includes a linear strip 172 and plural shaped charges arranged in a phased pattern with respect to the strip 172. In the illustrated embodiment, the 0°-phased shape charges 174 are mounted directly to the strip 172 by a threaded connection. The other charges are contained inside the tubes 176, which are attached to the strip 172. Openings 178 are provided in each tube 176 for corresponding shaped charges.

As shown in FIG. 10B, each of the loading tubes 176 can be made from a sheet metal 180 that has an array of openings 178. The sheet metal 180 is rolled into a cylindrical shape to form the loading tube 176. Depending on the desired arrangement of the shaped charges, the charges can be mounted to face through different combinations of the openings 178 to achieve the desired phasing pattern.

Various embodiments of brackets have been described for mounting capsule charges in a phased pattern with respect to a carrier strip. The brackets can be a twisted bracket having multiple support rings to attach more than two capsule charges. Alternatively, the brackets can be of the type in which each holds a pair of capsule charges in a phased arrangement, with multiple brackets used to hold more than two capsule charges with respect to the carrier strip. In other arrangements, the brackets can be tubes in which the capsule charges may be mounted.

Figure 13:
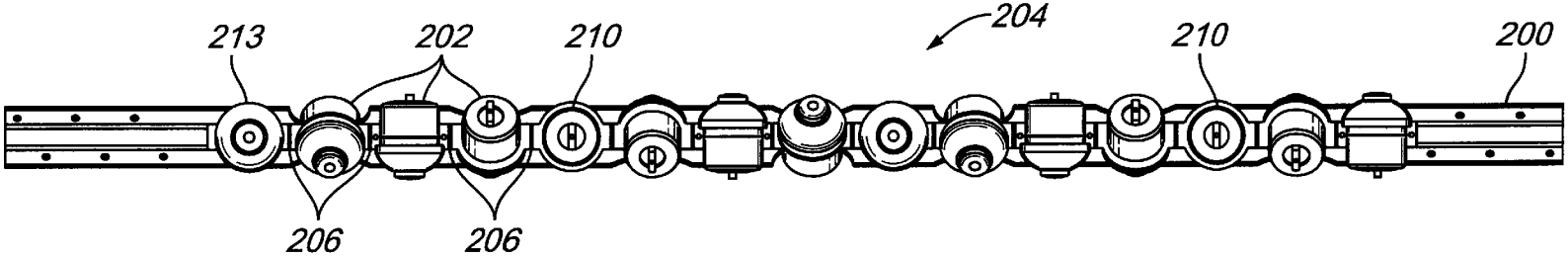
FIGS. 13–15 illustrate another embodiment of a perforating gun including a linear carrier strip and phased capsule charges.
Figure 14:
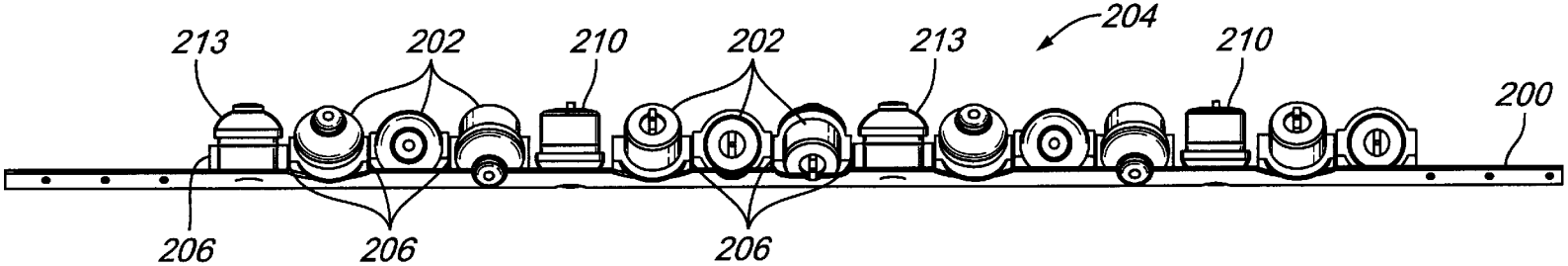
Figure 15:
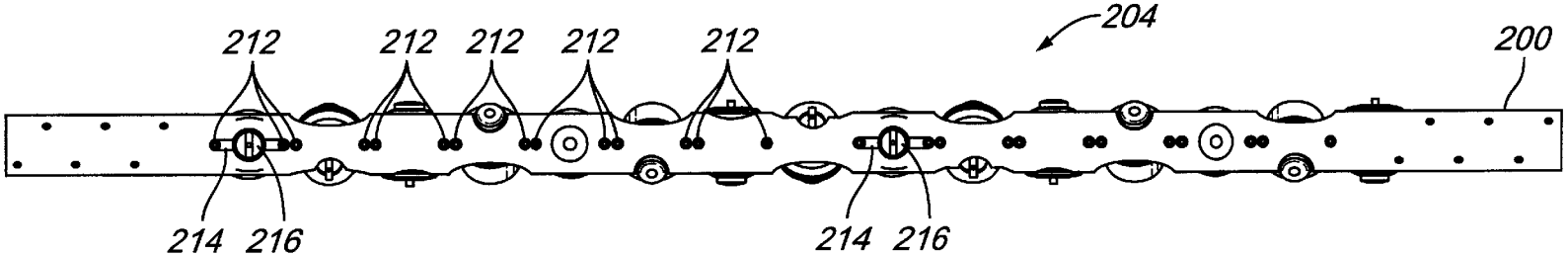

Referring to FIGS. 13–15, an alternative perforating gun 204 includes a linear strip 200 and capsule charges 202 in which individual mounting brackets 206 (one bracket 206 per capsule charge 202) are used instead of a bracket capable of mounting plural capsule charges. The phasing pattern of the perforating gun 204 includes capsule charges arranged in the 45° spiral phasing pattern similar to the pattern of the perforating gun 21 illustrated in FIGS. 9A–9B. However, instead of a continuous piece of retainer bracket 122 as used in the perforating gun 21, the perforating gun 204 uses individual mounting brackets 206 each holding a single capsule charge (202, 210, 213). Capsule charges 210 are the 0°-phased charges, capsule charges 213 are the 180°-phased charges, and capsule charges 202 are the other charges. An example of a mounting bracket 206 is described in U.S. Pat. No. 5,095,999, entitled "Through Tubing Perforating Gun Including a Plurality of Phased Capsule Charges Mounted on a Retrievable Base Strip Via a Plurality of Shatterable Support Ring," granted on Mar. 17, 1992, and which is hereby incorporated by reference.

In one embodiment, the 0°-phased capsule charges 210 are directly mounted onto the linear strip 200 by engaging the nose of each capsule charge 210 into the threaded opening provided by the linear strip 200. An advantage this offers is that debris may be reduced by not using brackets for the 0°-phased capsule charges 210.

Figure 16:
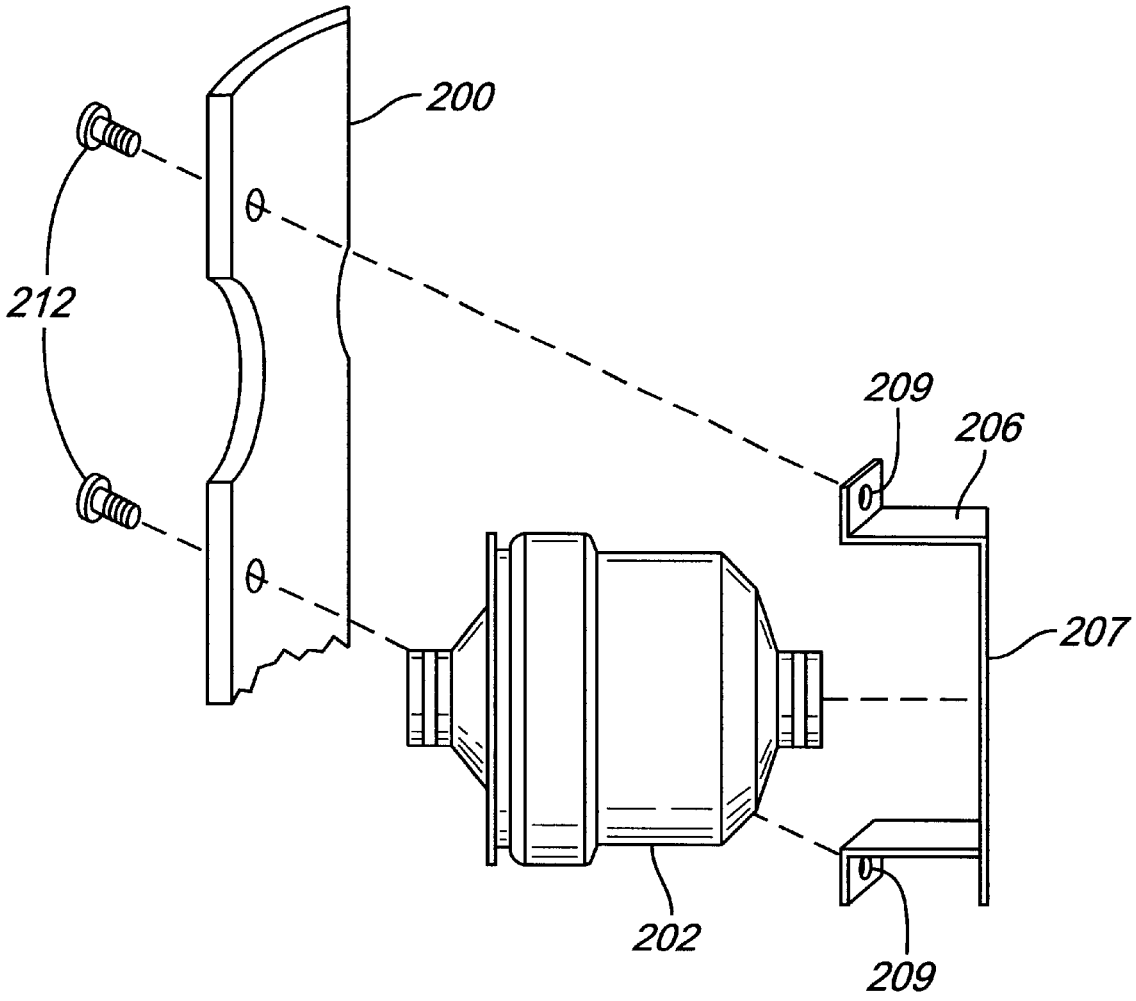
FIG. 16 illustrates a mounting bracket in accordance with one embodiment for use in the perforating gun of FIG. 13.

Referring further to FIG. 16, a capsule charge 202 is placed into a support ring 207 of the mounting bracket 206. The mounting brackets include a pair of threaded holes 209 into which screws 202 may be inserted to attach the bracket 206 to the strip 200. Positions of the screws 212 on the back side of the strip 200 are illustrated in FIG. 15. As also shown in FIG. 15, for the 180°-phased capsule charges 213, a slot 214 may be formed in the linear strip 200 through which a detonating cord (not shown) may be fitted to engage the detonating cord retainer 216 of the capsule charge 213.

Figure 17:
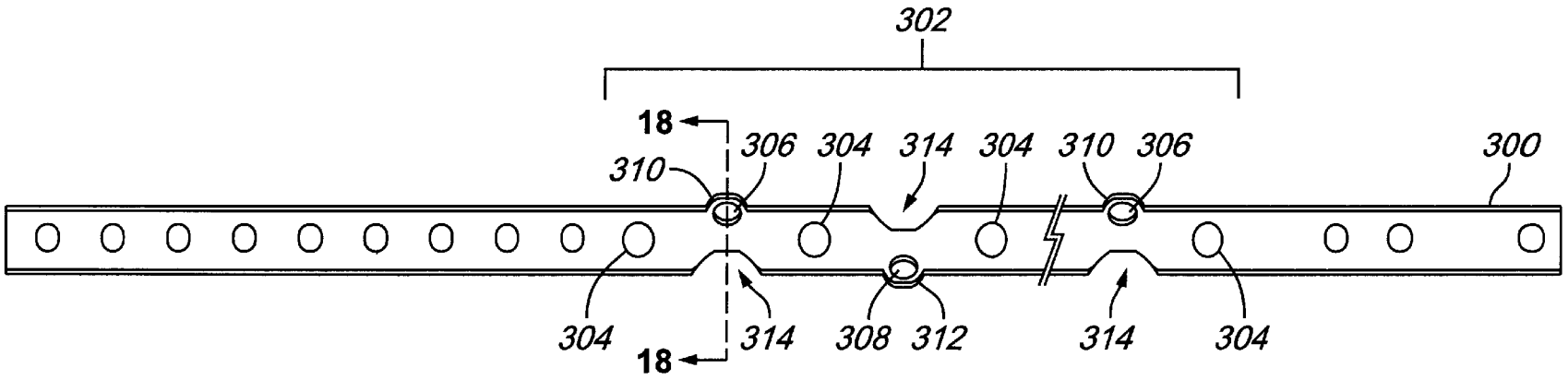
FIGS. 17–19 illustrate a strip in accordance with a further embodiment on which capsule charges may be mounted in a phased pattern.
Figure 19:
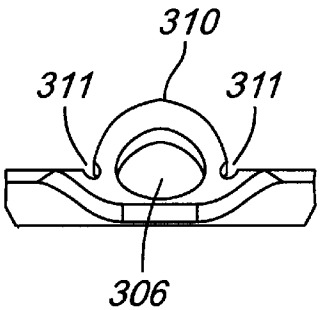
Figure 18:
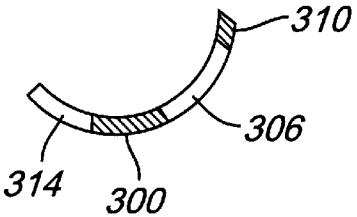

Referring to FIGS. 17–19, a linear strip 300 according to yet another embodiment does not employ separate brackets to mount capsule charges in desired phasing patterns. Instead, the capsule charges are mounted or attached directly onto the strip 300 in a phased arrangement. As shown in FIG. 17, a portion 302 of the linear strip 300 provides a 0°/+45°/−45° twisted phasing pattern. The 0°-phased capsule charges may be mounted in threaded openings 304. In addition, extension members 310 and 308 protrude from the two sides of the strip 300. The extension members 310 provide threaded openings 306 and the extension members 312 provide threaded openings 308 in which capsule charges may be mounted. The capsule charges mounted in openings 306 are +45°-phased capsule charges and the capsule charges mounted in the openings 308 are −45°-phased capsule charges.

The extension members 310 and 312 hold the capsule charges in their respective positions until the capsule charges are detonated. When the capsule charges detonate,. portions of the extension members 310 and 312 are designed to shatter and break off the edges of the main body of the strip 300. This reduces deformation of the main body of the strip 300, thus making the remaining part of the strip 300 suitable for retrieving to the surface. The extension members 310 and 312 have enough mechanical strength to hold and maintain the position of the capsule charges while running the gun downhole. However, once the capsule charges detonate, the extension members 310 and 312 break off and are released from the main body of the strip 300. The extension members 310 and 312 may be made to shatter and break by one of several techniques: the material used to form the extension members may be heat treated; or an abrupt change can be made to the cross-sectional area when crossing from the main body of the strip 300 to the extension member. Another technique is to form undercuts 311 in the region connecting the extension members 310 to the main body of the strip 300. The extension members 310 and 312 may have various shapes: generally circular, semi-circular, or any other shape that is conducive to severing from the main body of the strip 300. As shown, cuts 314 are formed on the side of the strip 300 opposite the extension member. The cuts 314 provide a path for explosion debris during detonation of a capsule charge such that deformation of the strip 300 caused by the force of the explosion debris is reduced. Referring to FIG. 18, a cross-section of the gun strip 300 at a portion including an extension member 310 is illustrated.

In the illustrated embodiment of FIG. 17, the extension members 310 and 312 are attached to capsule charges by threaded connections. In further embodiments, other attachment mechanisms may be utilized, such as fasteners, brackets, and so forth.

The linear strip 300 may be manufactured using several processes. The linear strip 300 may be laser cut or punched from a tube. Alternatively, the linear strip 300 may be manufactured by casting or forging a fabricated piece of sheet material or an extruded material. Other types of manufacturing processes may also be used.

In addition to increased flexibility in mounting of shaped charges, strips according to some embodiments of the invention also have other features for improved reliability and usability. Referring again to FIG. 2, blast relief cuts and capsule charge nose receiving cuts of various sizes are formed along the two edges 103A and 103B of the strip 20A. At each position on the strip 20A corresponding to a position of a capsule charge, a pair of cuts are formed, one on each of the sides 103A and 103B. As discussed above, the opening 100A is adapted to be engaged with the threaded nose 102 of the capsule charge 25 to provide for a 0°-phased capsule charge. The next capsule charge in the sequence (which is a 45°-phased capsule charge) is mounted over a pair of cuts 140A and 140B. The nose receiving cut 140A in the edge 103A is provided to receive the nose of the capsule charge. The blast relief cut 140B in the other edge 103B provides a path for explosion debris (from shattering of the capsule charge) so that deformation of the strip 20A is reduced. When a capsule charge detonates, shattered portions explode from the sides and rear of the capsule charge at great force. Providing an open area (blast relief cuts on the edges) through which such explosion debris can pass reduces stress applied on the strip 20A as a result of charge detonation.

The next pair of blast relief cuts 142A and 142B are formed for the 90°-phased capsule charge to provide paths for explosion debris from the sides of the 90°-phased capsule charge. The next set of cuts 144A and 144B are provided for the 135°-phased capsule charge. The blast relief cut 144B is a relatively large cut (larger than the other cuts) that is in the path of debris exploding from the rear of the 135°-phased capsule charge. The cut 144A is in the path of debris coming from the side of the 135°-phased capsule charge. Each of the openings 100B and 100D is adapted to receive the detonating cord retainer 108 at the back of the 180°-phased capsule charge. Additional blast relief cuts are provided along the edges 103A and 103B strip 20A for the other capsule charges.

Figure 21A:
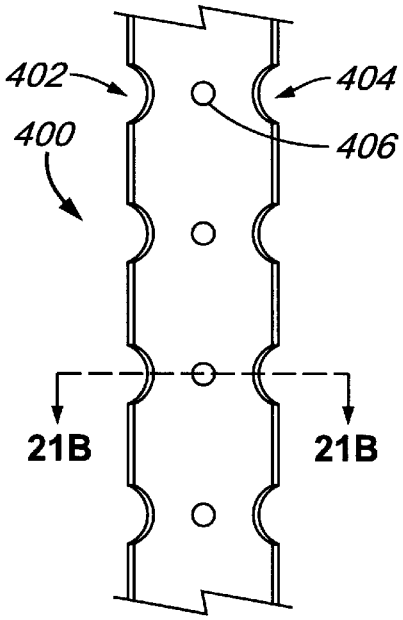
FIGS. 21A and 21B illustrate a generic strip that is adaptable to provide multiple different phased arrangements.
Figure 21B:
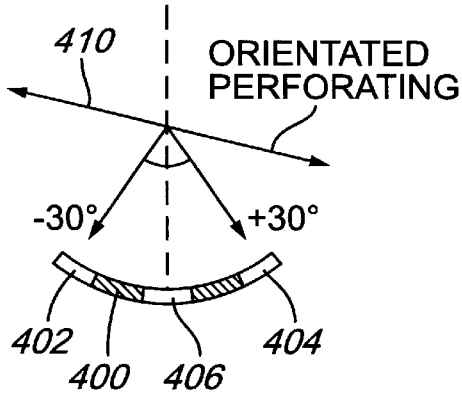

Referring to FIGS. 21A and 21B, in another embodiment, a generic strip 400 may be configured to hold capsule charges in a number of different phased arrangements. Pairs of cuts 402 and 404 are formed along the two sides of the strip 400 and openings 406 are formed along the axial length of the strip 400. The cuts 402 and 404 may be arranged for capsule phasings having 0° phasing and phasings defined outside a ±30° sector or a ±45° sector, as examples. Such a design may allow different phasings to be achieved with the same strip. For example, a 45° and 60° spiral phasing may be provided by the strip 400. Also, if oriented perforating is desired, in which charges are shot in two opposite directions (indicated as 410), those opposite directions may be varied through the ±30° sector, as illustrated in FIG. 21B.

Figure 4:
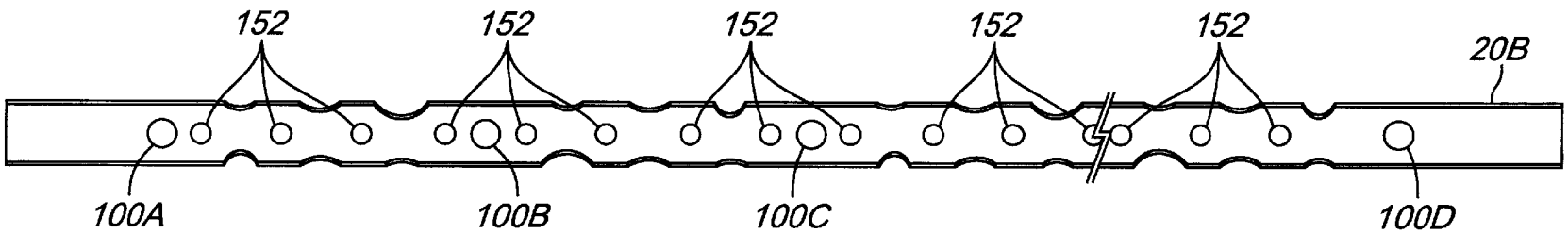
Figure 5:
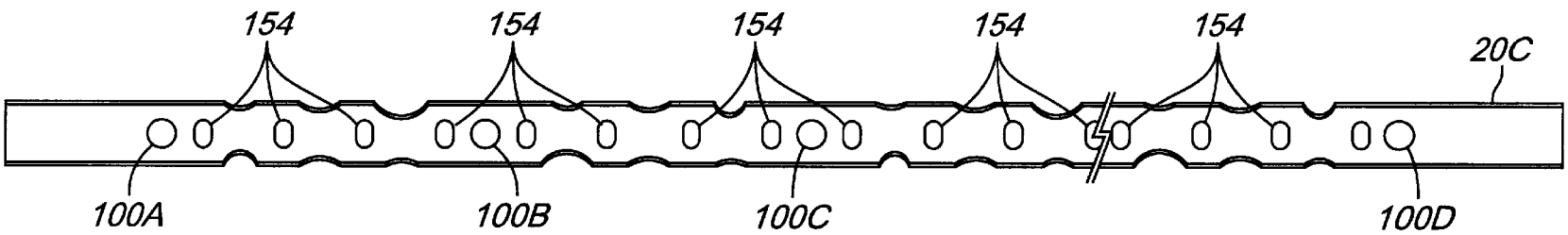

Referring to FIG. 4, a linear strip 20B according to another embodiment is the same as the strip 20A (FIG. 2) except that pressure equalization openings 152 are provided along the length of the strip 20B. The openings 152, which are generally circular, provide pressure equalization during detonation of the capsule charges so that pressure waves created in the wellbore during detonation is able to flow through the openings 152 to reduce the amount of deformation of the strip 20B. Referring to FIG. 5, a linear strip 20C according to yet another embodiment is the same as the strip 20B except that generally oval-shaped or oblong pressure equalization openings 154 are provided instead of the generally circular openings 152 of the strip 20A. Other arrangements and shapes of the pressure equalization openings 154 may be provided in further embodiments.

Another advantage of the carrier strip according to some embodiments is that it is designed to be on one side of the effective diameter of the tool to provide an eccentric weight on one side. In a deviated or horizontal well, the carrier strip lies against the well casing. Upon detonation, contact between the carrier strip and the well casing reduces or prevents major deformation of the carrier strip as a result of the gun detonation. In a deviated or horizontal well, the strip is the heavy side that tends to orient the strip against the inner wall of the casing. The generally concave shape of the lower surface of the carrier strip in accordance with some embodiments is generally matched to the casing curvature. As a result, when the capsule charges are detonated, the strip is compressed against the casing so that deformation of the strip is reduced.

A further advantage of the carrier strip in accordance with some embodiments is that it protects a detonating cord attached to the capsule charges as the gun is run downhole. Since the strip provides at least part of an eccentric weight, the bottom surface of the strip is in abutment with the casing wall or the pipe or tubing wall as the carrier strip is lowered downhole. This reduces the likelihood of damage to the detonating cord due to rubbing or entanglement with downhole structures as the gun is lowered. Such an advantage is applicable both for retrievable and expendable guns. With an expendable gun, the strip may be formed of aluminum or other expendable material. Thus, the strip has advantageous uses for expendable strips in providing flexible phasing patterns.

Other advantages offered by some embodiments may include one or more of the following. Reduced deformation of the gun strip due to detonation of capsule charges enables a strip of a retrievable gun to be retrieved more easily after firing. Linear strips may be employed in some embodiments so that more complex strip shapes may be avoided to reduce manufacturing complexity and costs. Flexible phasing patterns may be provided to improve productivity of a well formation. Also, the strips may be more easily adapted for different phasing patterns than conventional systems. A further advantage is that the strip (in either a retrievable or expendable gun) provides an eccentric weight so that the lower surface of the strip is in contact with the wall of a pipe, tubing, or casing as the gun is lowered into a deviated well. This protects the detonating cord of the gun, which is attached to the rear of the capsule charges, from rubbing against or becoming entangled with other downhole structures.

Another application of a strip gun in accordance with further embodiments is to use them for oriented perforating. The capsule charges may be attached to the strip using any of the mechanisms described above to be in desired orientation(s) with respect to the strip. In one embodiment, two or less perforating directions (180° orientation or 0° orientation) are used for oriented perforating. The strip, being the heavy side of the gun, would tend to rotate to the lower side of a deviated or horizontal wellbore by gravitational forces as the gun is run into the wellbore. The strip, representing the low side of the wellbore, provides a reference point so that capsule charges may be attached in a predetermined arrangement with respect to the strip to perform oriented perforating.

Figure 22A:
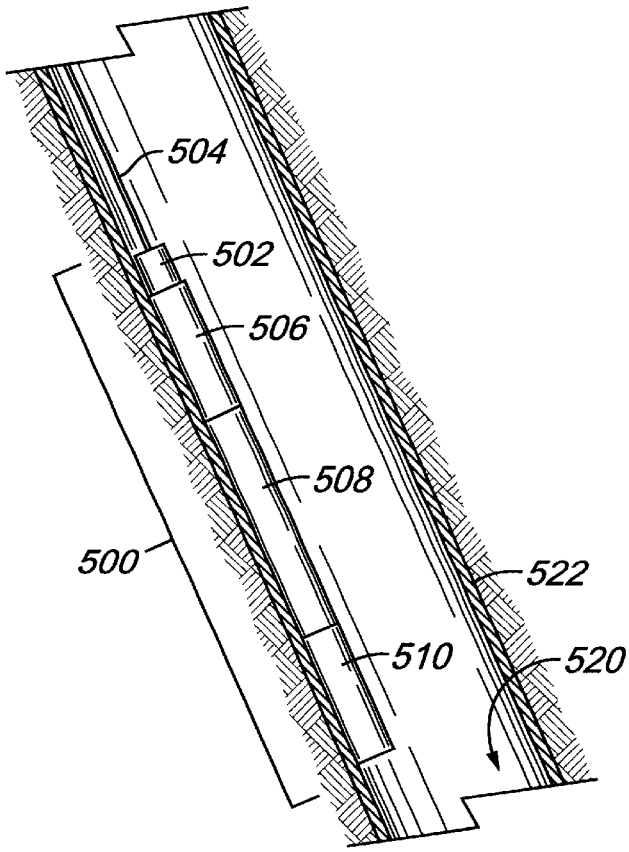
FIGS. 22A and 22B illustrate a perforating gun string in accordance with one embodiment for performing oriented perforating.
Figure 22B:
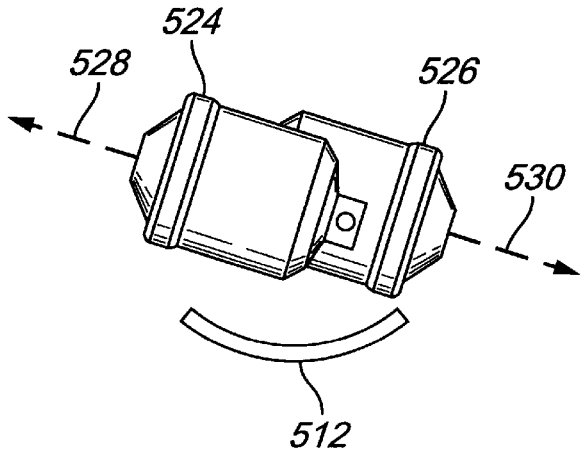

Referring to FIGS. 22A and 22B, a perforating gun string 500 is illustrated. The perforating gun string 500 may include a swivel 502 attached to a wireline or slickline 504. The swivel 502 removes the torque that may exist in the wireline or slickline 504 from being applied on the remaining components of the gun string 500 so that a perforating gun 508 may be properly oriented to perform oriented perforating. The perforating gun 508 includes a strip 512 (FIG. 22B) having capsule charges 524 and 526 mounted in a phased arrangement to shoot in two opposite directions 528 and 530. Any of the brackets discussed above may be employed to orient the capsule charges in the desired directions. The strip 512 provides at least part of an eccentric weight to cause it to lie against the low side of casing 522 in a deviated or horizontal wellbore 520. Furthermore, in addition to the weight of the strip, additional weights may be added to the gun 508 to add to the eccentricity. The capsule charges 524 and 526 are adapted to shoot in the 0° and 180° directions with respect to a stress plane in the surrounding formation.

Typically, for maximum productivity, the perforating direction is in a direction perpendicular to the plane of minimum stress. Such oriented perforating is typically used in fracturing operations to extend fractures into the surrounding formation for improved fluid flow. To further aid in orienting the gun 508, magnetic devices 506 and 510 may be attached above and below the gun 508.

The desired directions of perforations may be determined using a tool to determine the stress planes in the surrounding formation. Such information is correlated to the low side of the wellbore 520, from which the directions of the charges 524 and 526 can be determined with respect to the strip 512, which represents the low side of the wellbore 520.

A discussion of oriented perforating and various types of guns that can be used for oriented perforating is discussed in U.S. Ser. No. 09/292,151, entitled "Orienting Downhole Tools," filed Apr. 15, 1999, which is hereby incorporated by reference.

Figure 23:
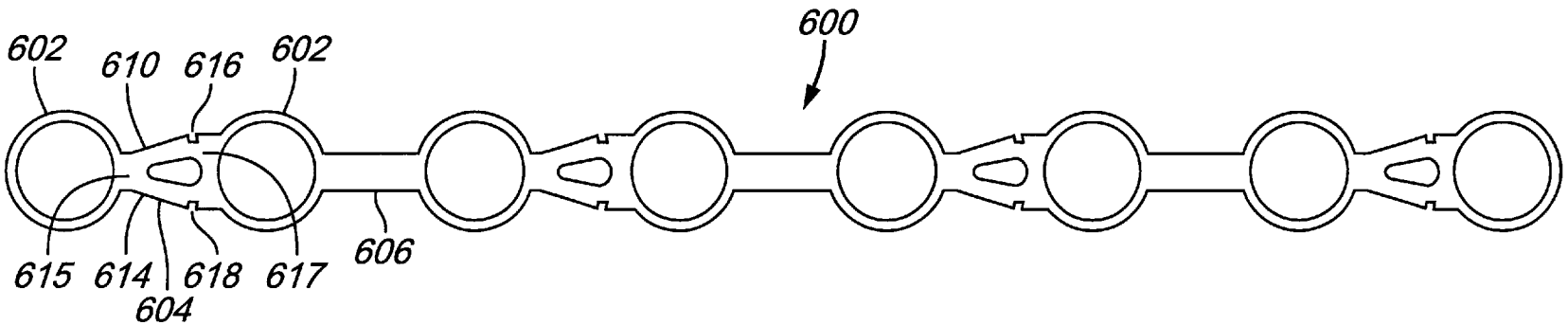
FIGS. 23 and 24A–24B illustrate a bracket and a retainer clip cooperable with the bracket to orient charges in a desired orientation.
Figure 24B:
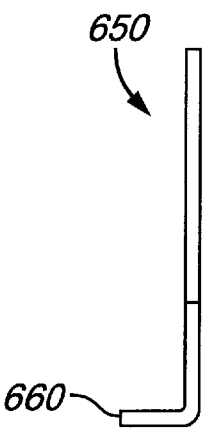
Figure 24A:
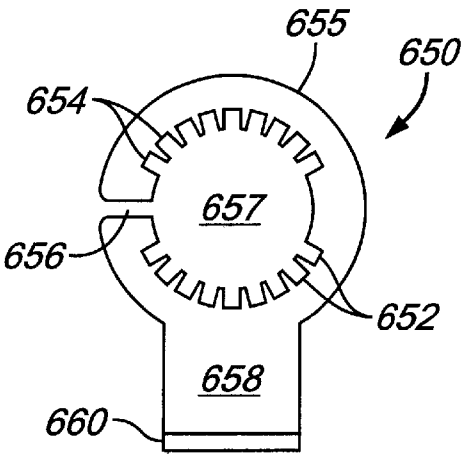

Referring to FIGS. 23 and 24A–24B in accordance with another embodiment, a retaining bracket 600 is cooperable with a retaining clip 650 to perform orientated perforating. The retaining bracket 600 includes multiple support rings 602 to receive capsule charges. Two types of integral connectors 606 and 604 are provided between successive support rings 602. The first type of connector 606 is a relatively straight connector. However, the second type of connector 604 has slanted sides 610 and 614 as well as grooves 616 and 618 on respective sides 610 and 614. The second type connector 604 has a first portion 615 with a smaller width and a second portion 617 having a larger width.

The second type connector 604 is designed to fit into the retaining clip 650 (FIG. 24A). As shown in FIG. 24A, the retaining clip 650 has a portion 655 that is generally ring-shaped, with the inside of the ring having a plurality of slots 652 and 654. Each corresponding pair of slots 652 and 654 (on opposite points of the ring) provides a predetermined angular orientation with respect to the strip. Each pair of slots 652, 654 is offset from the adjacent pair by about 5° in one embodiment. The connector 604 is designed to fit into a selected pair of the slots 652, 654, depending on the desired angle of the bracket 600 with respect to the strip. A gap 656 in the ring-shaped portion 655 is provided through which the connector 604 can be passed into the inner opening 657 of the ring-shaped portion 658 of the retaining clip 650.

The retaining clip 650 also has a generally L-shaped member 658 having a lower connection member 660 designed for attachment to a strip by a fastener (e.g., screws, rivets, etc.). Two or more of the retaining clips 650 can be mounted to a strip. Once the retaining clips 650 are mounted, corresponding connectors 604 of the bracket 600 can be fitted through the gap 656 of each retaining clip 650, with the narrow end 615 of the connector 604 inside the opening 657 of the retaining clip 650. The bracket 600 can then be rotated to a desired angle with respect to the carrier strip. Once a pair of slots 652, 654 corresponding to the desired angle is selected, the bracket 600 can then be moved along its axial axis so that the wider portion 617 of the connector 604 slides into the desired pair of slots 652, 654. The grooves 616, 618 in the connector 604 are designed to snap into slots 652, 654 of the retaining clip 650. Once the bracket 600 is snapped into place inside the retaining clips 650, the perforating gun is ready to be run into a wellbore for oriented perforating.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A perforating gun, comprising:

a plurality of capsule charges;

a carrier strip; and a bracket to hold the plurality of capsule charges in a phased arrangement having a plurality of perforating directions, the bracket coupled to the carrier strip, wherein the bracket comprises a tube mounted on the carrier strip, the shaped charges mounted inside the tube.

2. The perforating gun of claim 1, wherein the tube has a plurality of openings through which the shaped charges face.

3. The perforating gun of claim 2, wherein the number of openings is greater than the number of shaped charges to enable selection of one of plural phasing patterns.

4. The perforating gun of claim 1, wherein less than all of the capsule charges are mounted in the strip.

5. The perforating gun of claim 4, wherein the capsule charges mounted in the strip comprise 0°-phased capsule charges and the remaining capsule charges have other phasings.

6. The perforating gun of claim 1, wherein the carrier strip extends less than a full circumference when viewed from the top.

7. A method of performing multi-directional perforating, comprising:

attaching plural capsule charges to a bracket coupled to a carrier strip in a phased arrangement having a plurality of perforating directions;

contacting at least some of the capsule charges attached to the bracket to the carrier strip;

lowering the strip into a well; and detonating the capsule charges, wherein the bracket is not directly attached to the carrier strip.

8. The method of claim 7, wherein the attaching comprises attaching the capsule charges in the bracket having a plurality of support members twisted with respect to each other to provide the phased arrangement of the capsule charges.

9. The method of claim 7, wherein the attaching comprises attaching pairs of the capsule charges in a plurality of corresponding brackets, the method further comprising attaching the brackets to the carrier strip.

10. The method of claim 7, further comprising providing threaded openings in the carrier strip in which at least some of the capsule charges are mounted.

11. An oriented perforating device for use in a deviated or horizontal wellbore, comprising:

a strip extending less than a full circumference when viewed from the top; and capsule charges arranged in at two or less predetermined orientations with respect to the strip, the strip providing at least part of an eccentric weight to rotate the perforating device so that the strip is at a low side of the deviated or horizontal wellbore and the capsule charges are pointed in the two or less predetermined orientations with respect to the low side of the wellbore.

12. The perforating device of claim 11, wherein the strip comprises a linear strip.

13. The perforating device of claim 11, wherein the capsule charges are oriented in two opposite directions.

14. The perforating device of claim 11, further comprising a bracket to hold a plurality of the capsule charges.

15. The perforating device of claim 14, wherein the bracket has plural support rings to hold the capsule charges.

16. An oriented perforating device for use in a deviated or horizontal wellbore, comprising:

a strip;

capsule charges arranged in at two or less predetermined orientations with respect to the strip, the strip providing at least part of an eccentric weight to rotate the perforating device so that the strip is at a low side of the deviated or horizontal wellbore and the capsule charges are pointed in the two or less predetermined orientations with respect to the low side of the wellbore;

a bracket to hold a plurality of the capsule charges; and at least one mounting clip attached to the strip, the bracket engageable with the mounting clip in plural positions to enable adjustment of the bracket at a desired angle with respect to the strip.

17. The perforating device of claim 16, wherein the mounting clip has an inner ring with plural pairs of slots to provide the plural positions.

* * * * *